US011381014B2

(12) United States Patent
Hsu

(10) Patent No.: US 11,381,014 B2
(45) Date of Patent: Jul. 5, 2022

(54) ELECTRICAL CONTACT HAVING TWO SIDE-BY-SIDE PARTS WITH JOINED BOTTOM ENDS THEREOF

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Shuo-Hsiu Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/933,689

(22) Filed: Jul. 20, 2020

(65) Prior Publication Data

US 2021/0021067 A1 Jan. 21, 2021

(30) Foreign Application Priority Data

Jul. 18, 2019 (CN) ..... 201910651623.8

(51) Int. Cl.
*H01R 12/71* (2011.01)
*H01R 12/57* (2011.01)
(Continued)

(52) U.S. Cl.
CPC ..... *H01R 12/716* (2013.01); *H01R 12/57* (2013.01); *H01R 13/2442* (2013.01);
(Continued)

(58) Field of Classification Search
CPC ..... H01R 12/716; H01R 13/2442; H01R 13/2478; H01R 12/57; H01R 12/712;
(Continued)

(56) References Cited

U.S. PATENT DOCUMENTS

2008/0160844 A1* 7/2008 Chiang ..... H01R 13/2442 439/884
2009/0215291 A1* 8/2009 Taguchi ..... H01R 13/193 439/83

FOREIGN PATENT DOCUMENTS

CN 109524815 A 9/2017
CN 208571022 U 8/2018

* cited by examiner

*Primary Examiner* — Abdullah A Riyami
*Assistant Examiner* — Justin M Kratt
(74) *Attorney, Agent, or Firm* — Ming Chieh Chang; Wei Te Chung

(57) ABSTRACT

An electrical connector includes an insulative housing with a plurality of passageways extending through opposite upper and lower surfaces of the housing. A plurality of electrical contacts are received within the corresponding passageways, respectively. Each contact includes a first main body and a second main body side by side arranged with each other with a bridge transversely linked therebetween. At least one of the first main body and the second main body includes a retaining barb for retaining contact in the passageway. Two soldering pads are formed on the corresponding bottom ends of the first main body and the second main body, respectively. The two soldering pads intimately confront each other either in a horizontal direction or in a vertical direction, and are joined together via a solder ball located under the two soldering pads.

9 Claims, 9 Drawing Sheets

(51) Int. Cl.

| | |
|---|---|
| ***H01R 13/24*** | (2006.01) |
| *H01R 4/02* | (2006.01) |
| *H01R 13/428* | (2006.01) |
| *H01R 12/91* | (2011.01) |
| *H01R 12/73* | (2011.01) |

(52) U.S. Cl.
CPC ..... *H01R 13/2478* (2013.01); *H01R 4/02* (2013.01); *H01R 4/024* (2013.01); *H01R 12/712* (2013.01); *H01R 12/714* (2013.01); *H01R 12/73* (2013.01); *H01R 12/91* (2013.01); *H01R 13/245* (2013.01); *H01R 13/2407* (2013.01); *H01R 13/2414* (2013.01); *H01R 13/2492* (2013.01); *H01R 13/428* (2013.01)

(58) Field of Classification Search
CPC .... H01R 13/2407; H01R 13/245; H01R 4/02; H01R 4/024; H01R 13/428; H01R 12/73; H01R 12/91; H01R 12/714; H01R 13/2414; H01R 13/2492
USPC ..... 439/66, 68, 69, 83, 862, 875, 876
See application file for complete search history.

ELECTRICAL CONTACT HAVING TWO SIDE-BY-SIDE PARTS WITH JOINED BOTTOM ENDS THEREOF

BACKGROUND OF THE INVENTION

1. Field of the Invention

The present invention relates generally to an electrical contact for use with an electronic package having circuit pads thereon, and particularly to the contact having two soldering pads joined together via a solder ball thereunder.

2. Description of Related Arts

The traditional contact for use with an electronic package, e.g., the CPU (Central Processing Unit), essentially includes an upper spring arm for contacting the CPU, and a soldering pad with a solder ball thereon for mounting to a printed circuit board. Anyhow, a single soldering pad may result in a relatively large capacitive effect, thus increasing the signal loss in the high frequency transmission.

It is desired to provide an electrical contact with a lower capacitive effect.

SUMMARY OF THE INVENTION

To achieve the above object, an electrical connector includes an insulative housing with a plurality of passageways extending through opposite upper and lower surfaces of the housing. A plurality of electrical contacts are received within the corresponding passageways, respectively. Each contact includes a first main body and a second main body side by side arranged with each other with a bridge transversely linked therebetween. At least one of the first main body and the second main body includes a retaining barb for retaining the contact in the passageway. One spring arm extends from one end of one of the first main body and the second main body with a contacting section for mating with the CPU. Two soldering pads are formed on the corresponding bottom ends of the first main body and the second main body, respectively. The two soldering pads intimately confront each other either in a horizontal direction or in a vertical direction, and are joined together via a solder ball located under the two soldering pads.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
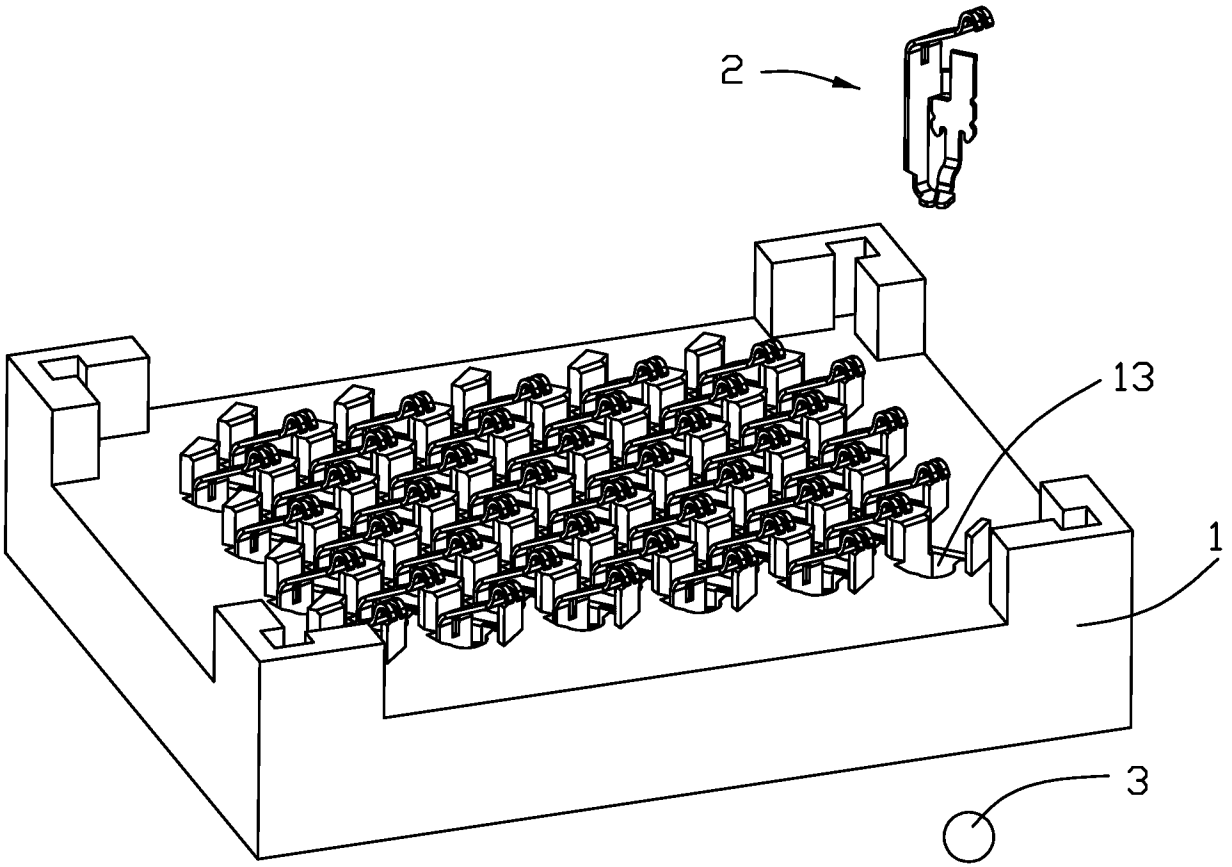
FIG. 1 is a perspective view of an electrical connector according to a preferred embodiment of the invention wherein one contact and the corresponding solder ball are exposed outside of the housing.
Figure 2:
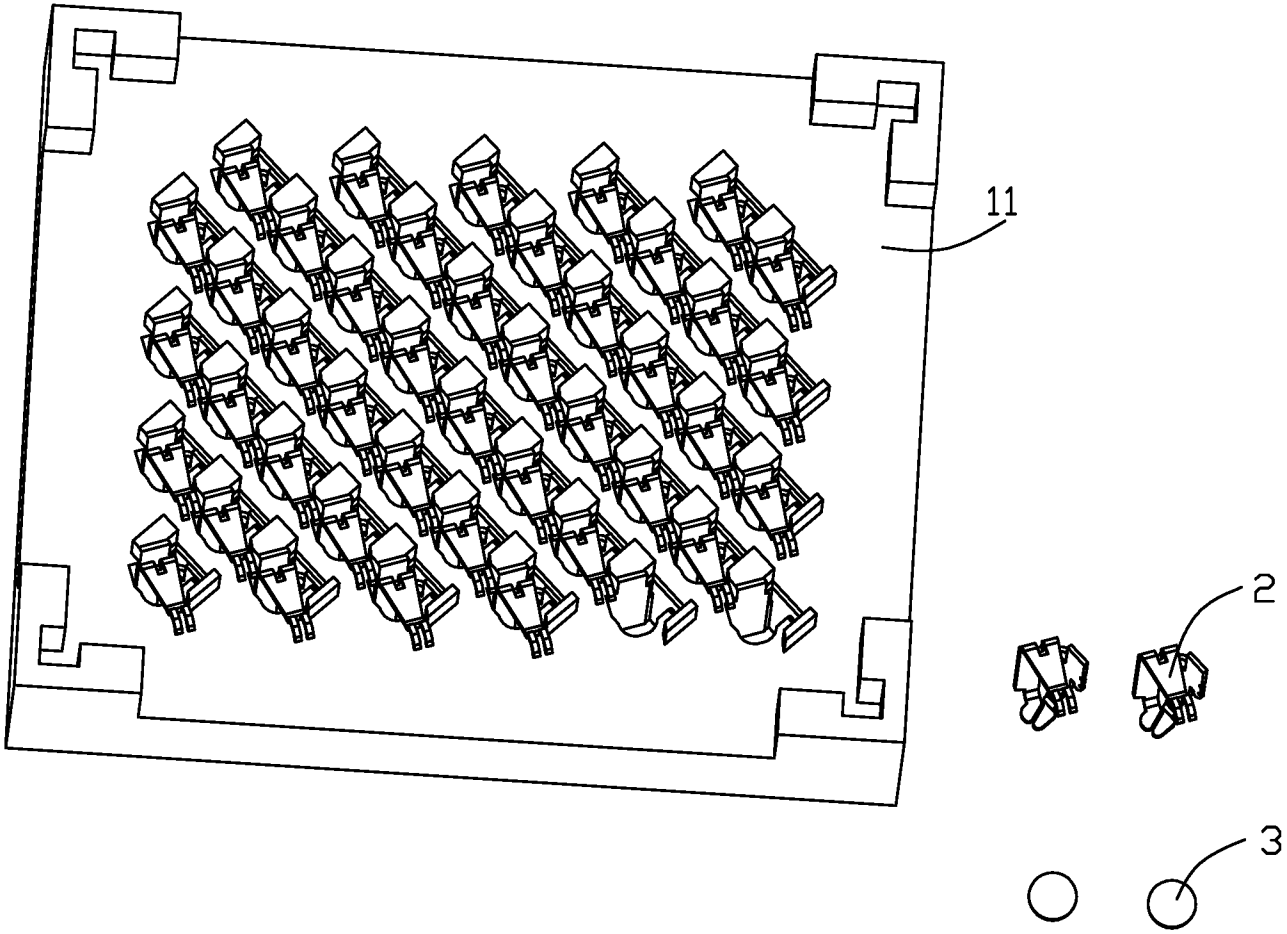
FIG. 2 is another perspective view of the electrical connector of FIG. 1 with an additional contact removed from the housing.
Figure 3:
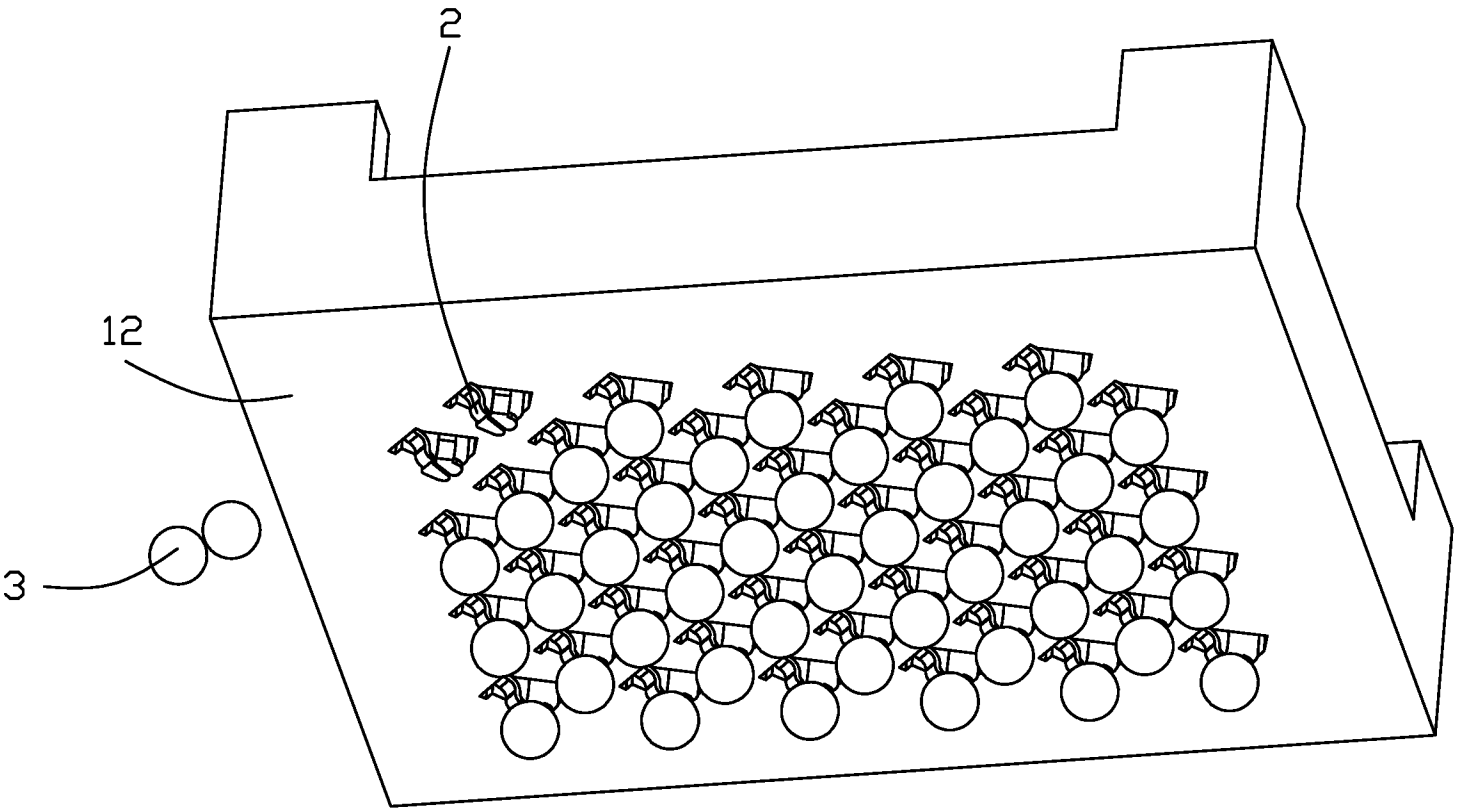
FIG. 3 is another perspective view of the electrical connector of FIG. 2.
Figure 4:
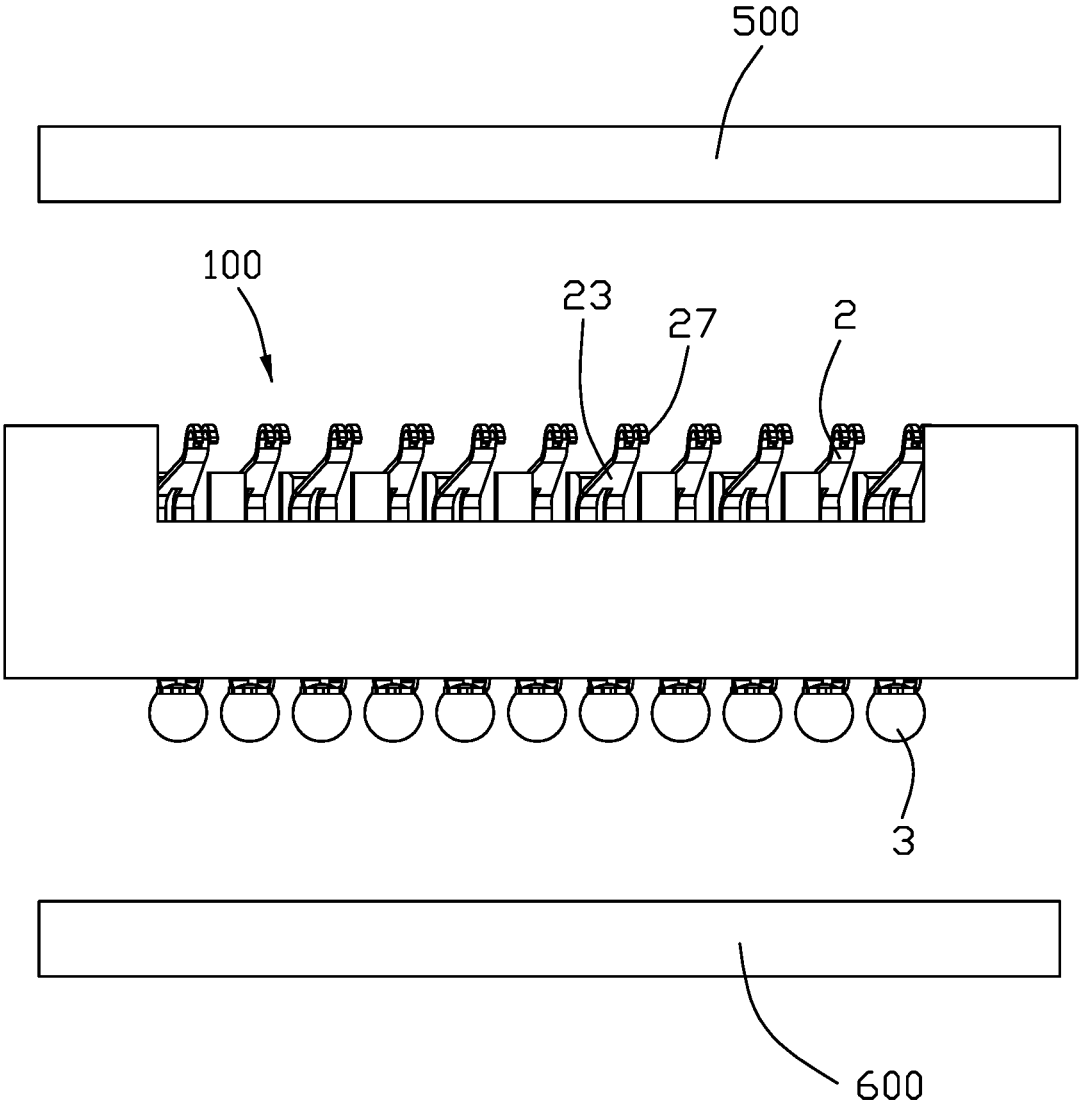
FIG. 4 is a side view of the electrical connector of FIG. 1.

Referring to FIGS. 1-8, an electrical connector 100 includes an insulative housing 1 with opposite upper surface 11 and lower surface 12. A plurality of passageways 13 extend through both the upper surface 11 and the lower surface 12 in the vertical direction. A plurality of contacts 2 are respectively received within the corresponding passageways 13, respectively.

The contact 2 includes a first main body 21 and a second main body 22 linking to each other via a bridge 26 transversely extending therebetween. The first main body 21 lies in a first plane and the second main body 22 lies in a second plane perpendicular to the first plane. A spring arm 23 extends upwardly from an upper portion of the first main body 21 with a contacting section 27 at a free end thereof. A first soldering pad 24 is formed at a lower portion of the first main body 21. A second soldering pad 25 is formed at a bottom portion of the second body 22. A first bending section 211 is located between the first main body 21 and the first soldering pad 24. A second bending section 222, a third bending section 223 and the fourth bending section 224 are sequentially formed between the second main body 22 and the second soldering pad 25. A pair of bars 221 are formed on two sides of the second main body 225 for retaining the contact 2 within the passageway 13. A connecting section 225 is located at an upper portion of the second main body 22 for linking to a contact carrier strip (not shown) for downwardly assembling the contact 2 into the passageway 13.

The contacting section 27 has a slot to form two separate contacting parts. A slot 231 is formed at a junction between the first main body 21 and the spring arm 23 for releasing forces. The first soldering pad 24 and the second soldering pad 25 are neighboring to each other in a coplanar manner. The solder ball 3 is joined with both the first soldering pad 24 and the second soldering pad 25. The first soldering pad 24 forms a first side edge 241, and the second soldering pad 25 forms a second side edge 251 confronting the first side edge with an optional tiny gap therebetween for forgiving manufacturing tolerance. Understandably, such a tiny gap may be omitted. The first soldering pad 24 further forms another side edge 242 and the second soldering pad 25 further forms another side edge 252 to cooperate with the side edge 242 for constituting the boundary of the common soldering pad unit. Notably, both the first main body 21 and the second main body 22 constitute a dual-path structure to result in a parallel circuit wherein a first path is from the spring arm 23, the first main body 21 and the first soldering pad 24 and a second path is from the spring arm 23, the upper portion of the first main body 21, the bridge 26, the second main body 22 and the second soldering pad 25, thus reducing signal loss during transmission between the CPU 500 and printed circuit board 600.

Figure 5:
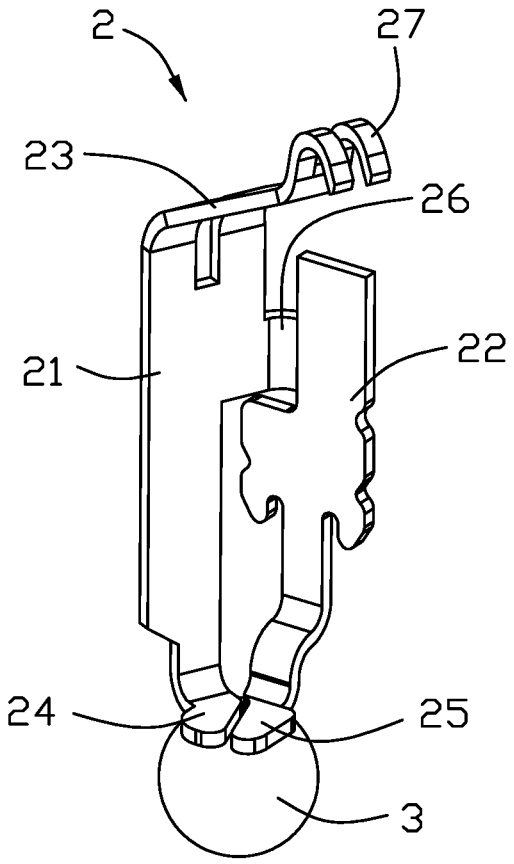
FIG. 5 is a perspective view of the electrical contact of the electrical connector of FIG. 1.
Figure 5A:
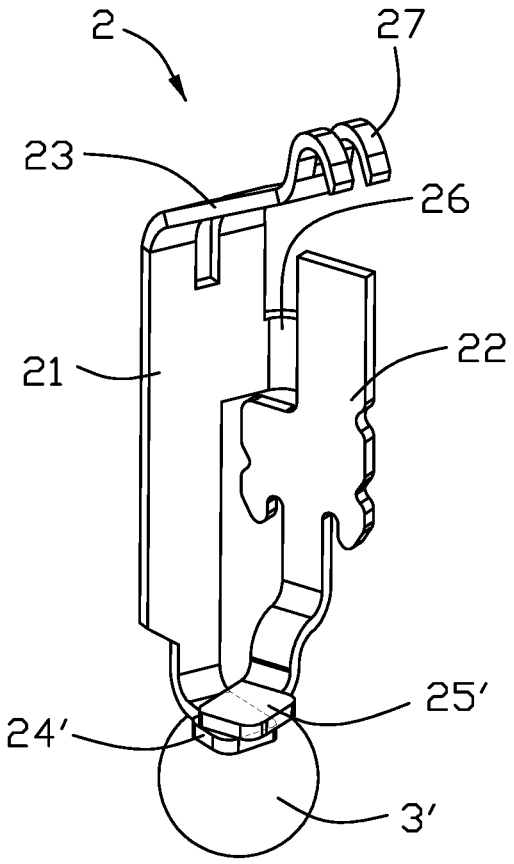
FIG. 5(A) is a perspective view of the electrical contact of the electrical connector according to another embodiment.
Figure 6:
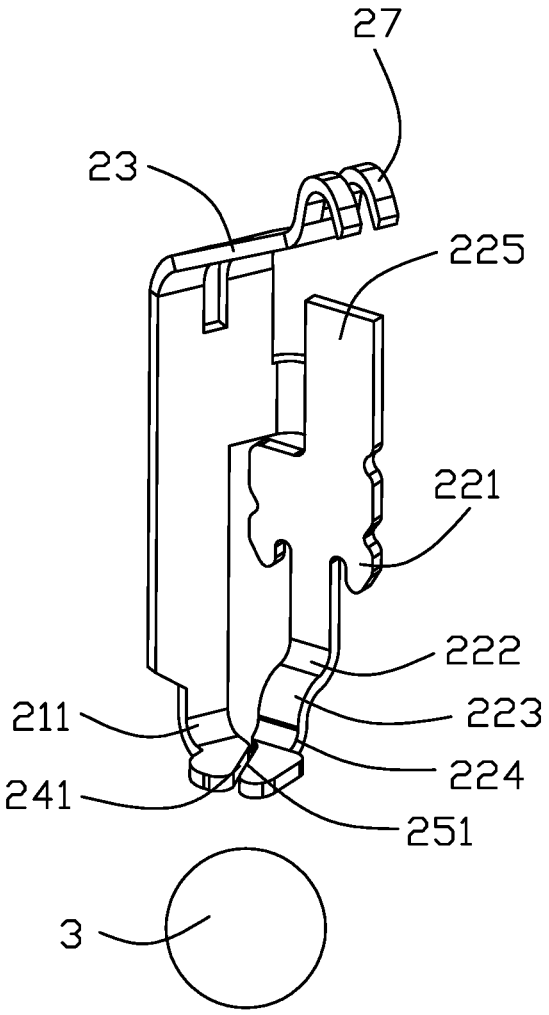
FIG. 6 is a perspective view of the electrical contact of the electrical connector of FIG. 5 wherein the solder ball is removed away from the contact main body.
Figure 7:
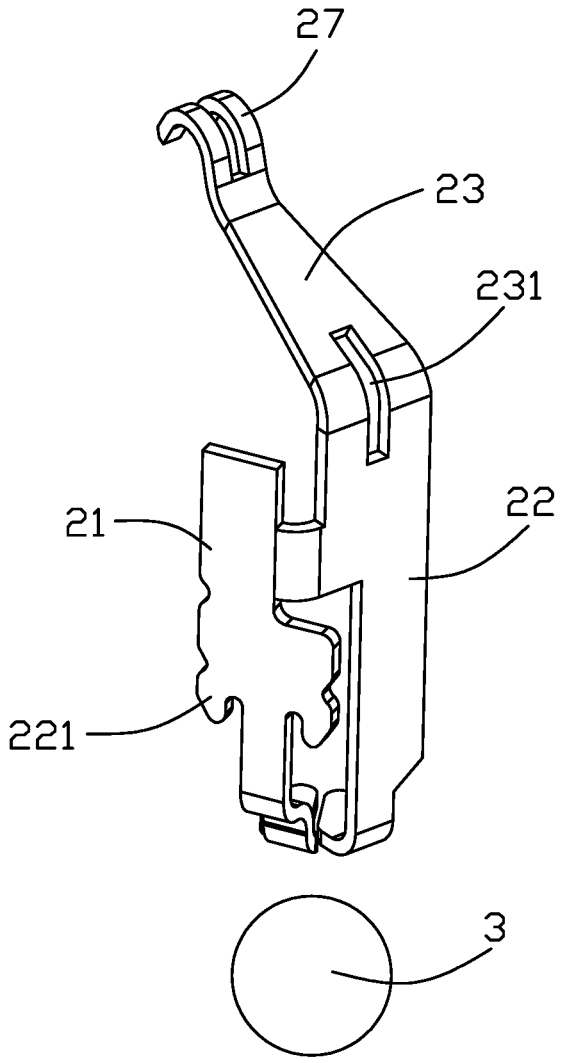
FIG. 7 is another perspective view of the electrical contact of the electrical connector of FIG. 6.
Figure 8:
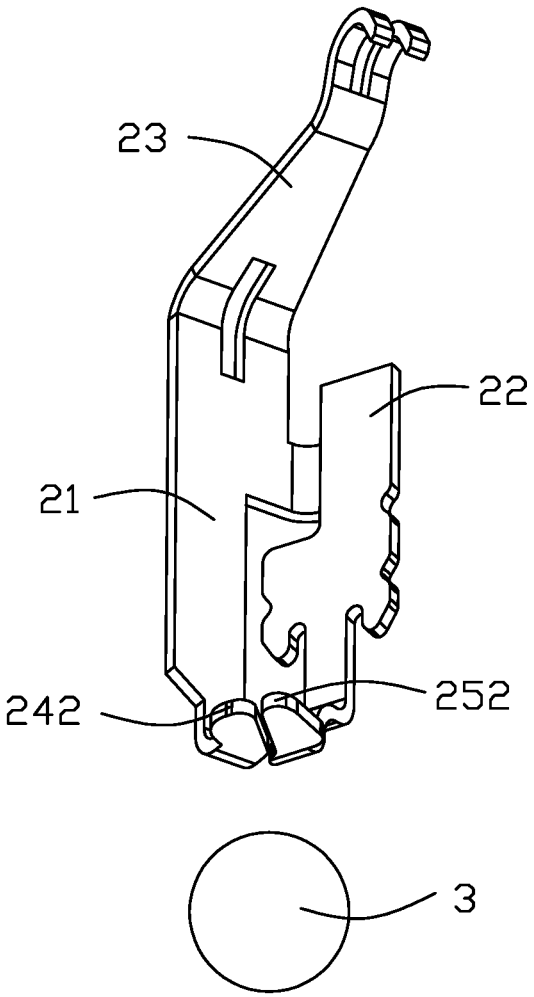
FIG. 8 is another perspective view of an electrical contact of the electrical connector assembly of FIG. 6.

Referring to FIG. 5(A), another embodiment shows the first soldering pad 24' and the second soldering pad 25' are stacked with each other rather than in a parallel relation wherein the soldering ball 3' is also joined with both the first soldering pad 24' and the second soldering pad 25' optimally.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for use between an electronic package and a printed circuit board, comprising:

an insulative housing forming an upper surface and a lower surface opposite to each other in a vertical direction;

a plurality of passageways formed in the housing and extending through both the upper surface and the lower surface;

a plurality of contacts disposed in the corresponding passageways, respectively, each of said contacts including:

a first main body lying in a first vertical plane;

a second main body lying in a second vertical plane;

a bridge linked transversely between the first main body and the second main body;

a spring arm extending from an upper portion of the first main body with a contacting section extending above the upper surface for mating with the electronic package;

a first soldering pad formed at a lower end of the first main body;

a second soldering pad formed at a lower end of the second main body; and a solder ball joined with both the first soldering pad and the second soldering pad and leveled below the lower surface for mounting to the printed circuit board.

2. The electrical connector as claimed in claim 1, wherein the first vertical plane is perpendicular to the second vertical plane.

3. The electrical connector as claimed in claim 1, wherein the first soldering pad and the second soldering pad are side by side arranged with each other in a coplanar manner.

4. The electrical connector as claimed in claim 3, wherein a tiny gap is formed between the first soldering pad and the second soldering pad.

5. The electrical connector as claimed in claim 1, wherein the first soldering pad and the second soldering pad are partially overlapped with each other in the vertical direction.

6. The electrical connector as claimed in claim 1, wherein the second main body forms barbs for retaining the contact in the corresponding passageway.

7. The electrical connector as claimed in claim 1, wherein an upper portion of the second main body is configured to be linked with a contact carrier strip for downwardly assembling the contact into the corresponding passageway.

8. The electrical connector as claimed in claim 7, wherein the bridge is located at a level which is lower than those of both the upper portion of the first main body and the upper portion of the second main body.

9. The electrical connector as claimed in claim 6, wherein the barbs are located at a level lower than that of the bridge.

* * * * *